United States Patent [19]

Godat et al.

[11] Patent Number: 5,017,017

[45] Date of Patent: May 21, 1991

[54] STIRRING APPARATUS FORMING AN ACCESSORY FOR SELECTIVE STIRRING OF THE BASE COLORS ON PAINT STIRRING MACHINES

[75] Inventors: Jean Godat, Olivet; Alain Krzywdziak, Orleans, both of France

[73] Assignee: Fonderie & Ateliers des Sablons, Orleans, France

[21] Appl. No.: 432,226

[22] Filed: Nov. 6, 1989

[30] Foreign Application Priority Data

Nov. 8, 1988 [FR] France ..... 88 14567

[51] Int. Cl.[5] ..... B01F 7/16

[52] U.S. Cl. ..... 366/251; 366/605

[58] Field of Search ..... 366/349, 348, 241, 242, 366/, 244, 247, 249, 251, 252, 297, 605, 279

[56] References Cited

U.S. PATENT DOCUMENTS 1,349,960 8/1920 Hoepner .
3,118,653 1/1964 Dedoes .
4,225,248 9/1980 Para ..... 366/279
4,407,584 10/1983 Boudin ..... 366/605

FOREIGN PATENT DOCUMENTS 867962 10/1961 United Kingdom .
2203059 12/1988 United Kingdom .

*Primary Examiner*—Robert W. Jenkins
*Attorney, Agent, or Firm*—Scully, Scott, Murphy & Presser

[57] ABSTRACT

A stirring arrangement including an accessory for selective stirring of the base colors contained in hanging paint pots in paint stirring machines. The stirring machines have racks for suspending the pots and devices for stirring the colors therein, with the stirring arrangement including a further rack receiving at least one stirring lid with an associated paint pot, suspended between cantilever slides on the rack, the lid and a stirrer which is attached thereto being rotated by a chain extending along the length of the further rack and actuating a drive pinion thereon. A drive unit for driving the chain connected to a drive shaft of the stirring machine disengages the machine in the operating condition of the stirring lid on the further rack without the racks on the stirring machine being activated, and in the inoperative condition of the further rack intermittently activating the racks of the stirring machine.

5 Claims, 3 Drawing Sheets

STIRRING APPARATUS FORMING AN ACCESSORY FOR SELECTIVE STIRRING OF THE BASE COLORS ON PAINT STIRRING MACHINES

This invention relates to a stirring apparatus forming an accessory for selective stirring of the base colors on paint stirring machines and in particular in the sector of paints or lacquers used for car bodies.

It is known that the stirring machines used for car bodies are designed to stir simultaneously all the paint base-color containers installed on them. Stirring of the colors is normally performed every six or twelve hours so that decantation of the matter is negligible and does not affect the colorimetric density of the colors. Since the amount of color used varies from one color to another, it often occurs that some colors run out during the day. The operator is thus required to stir a new container with the missing colour and therefore operate the stirring machine especially for this color. Stirring is performed for five to fifteen minutes until the said base is quite homogeneous. However, this has the drawback that the other bases already on the machine (from 40 to 100 depending on the machine) must also be stirred. The result is that these bases, in particular the bases which are not used a lot, are stirred too frequently and for too long and their qualities are adversely affected by this.

So-called fast-stirring apparatus exist, which enable the color bases installed during the day to be resuspended, but these devices mean that the entire stirring machine must be operated at a speed where the bases are stirred rapidly, thereby increasing the risk of creating an emulsion in the paint as a result of the introduction of air into the lacquer and possibly greatly altering the quality of the color before use.

French Patent Application No. 87 08 523, filed on June 18, 1987 in the name of the Applicant also discloses an apparatus for selective stirring of the paint base colors to be mounted in particular on paint stirring machines. This apparatus has an independent geared motor unit which must in particular be enclosed inside a flameproof housing so as to ensure safe operation on account of the solvent vapors which exist in the treatment of paints.

Such an installation is relatively costly and of little interest to users.

The invention aims to overcome this drawback and proposes a stirring apparatus forming an accessory for selective stirring of the base colors on paint stirring machines, consisting as a whole of a small rack of the same type as those of stirring machines, i.e. for machines with hanging pots, receiving at least one stirring lid with its paint pot, suspended between the cantilever slides of the rack, the lid being driven conventionally by a chain running along the length of the rack and actuating its drive pinion, and of a system for driving this rack, linked to the drive shaft of the stirring machine and designed to disengage the machine, ensuring in the working position of the system operation of the said stirring lid on the said rack without the racks of the machine being activated, and in the non-working position driving of all the racks of the machine.

As a result of this arrangement, the stirring apparatus according to the invention enables the missing colors to be stirred independently of those already installed on the stirring machine. The speed of rotation of the missing color installed is the same as that of the other stirring lids of the machine since the drive mechanism and the machine drive propulsion system are the same. It is therefore no longer necessary, as in the known art, to install an independent motor drive system for selective stirring of the bases, together with its safety protection means. The accessory apparatus of the stirring machines according to the invention consequently represents a notable improvement in this respect, as a result of the lower costs of the material required.

According to advantageous features of the invention, the stirring apparatus is mounted with fixing by means of flanges on its drive housing along the upright comprising the shafting for driving the racks, between the first bottom rack and the geared motor unit for driving the machine. The small rack is installed adjacent to the bottom rack of the machine, underneath the latter which has been freed beforehand along the length of the rack of the apparatus.

The said declutching system comprises essentially a positive-locking component located in the shafting for movement of the racks, between the pinion for driving the bottom machine rack and the output of the geared motor unit, this component sliding vertically under the biasing action of an operating lever. This component is constantly engaged at its base with the drive shaft and is capable of uncoupling itself at the top, in the working position, from the upper shafting for transmission of movement to the machine racks. Obviously in the non-working position, the positive-locking component reestablishes the shafting connection at the top and hence the movement of the machine racks. Transmission of movement to the adjoining small rack is effected conventionally, as on the machine racks, by a pinion integral with the shafting arranged in a fixed horizontal position underneath the top of the positive-locking component.

Since the speed of rotation of the shaft driving the racks is relatively small (of the order of 85 revolutions/-minute), positive-locking by means of conventional pinion teeth on the positive-locking component and the shafting end is preferred.

Vertical sliding of the positive-locking component is effected by means of an operating lever with a cylindrical base, the eccentric end of which cooperates with a complementary recessed part in the positive-locking component.

Other features and advantages of the invention will emerge from the description below of an example of embodiment of the invention and with reference to the appended drawings in which.

Figure 1:
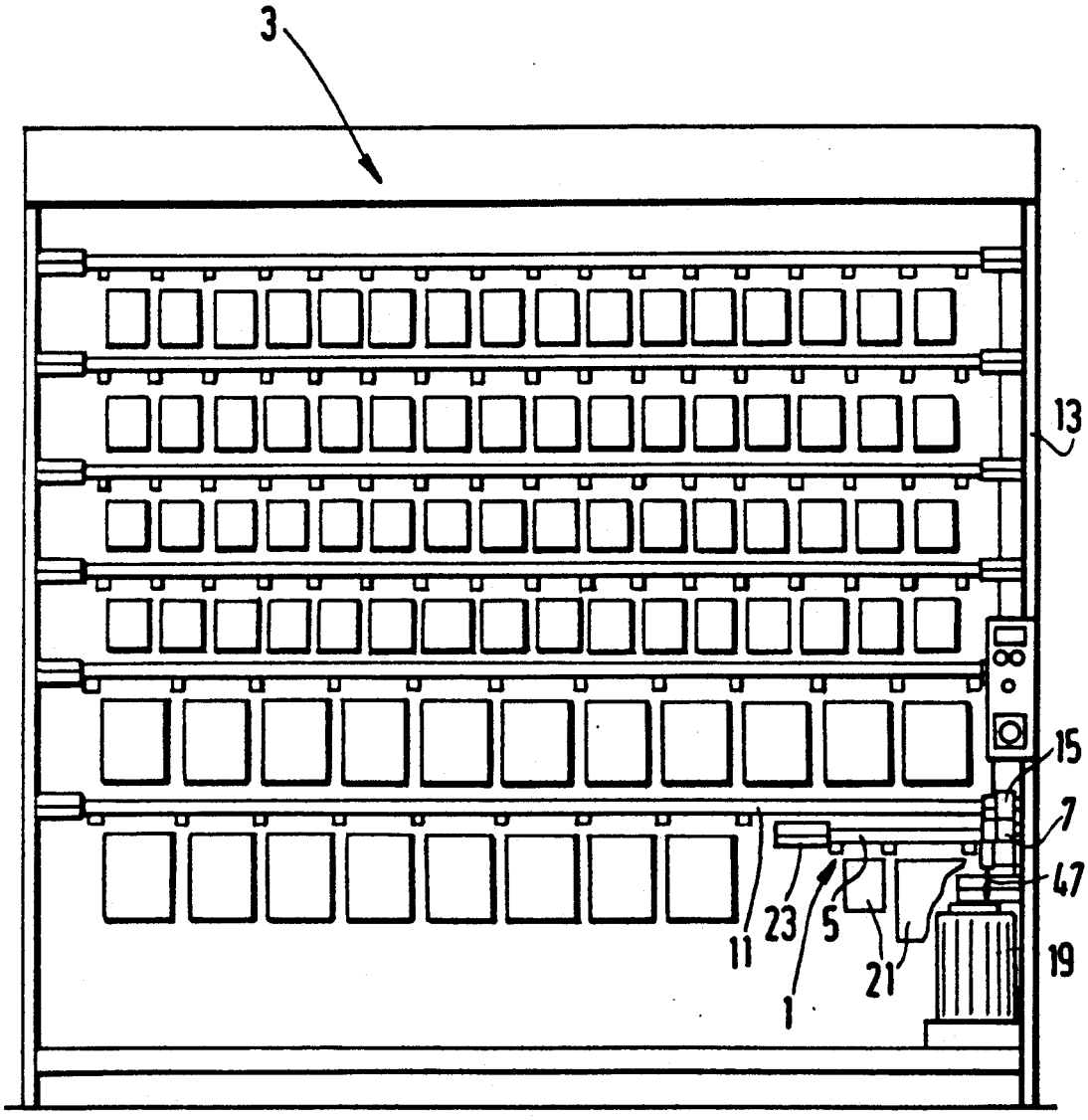
FIG. 1 is a schematic view of the apparatus according to the invention on a paint stirring machine with hanging pots.
Figure 2:
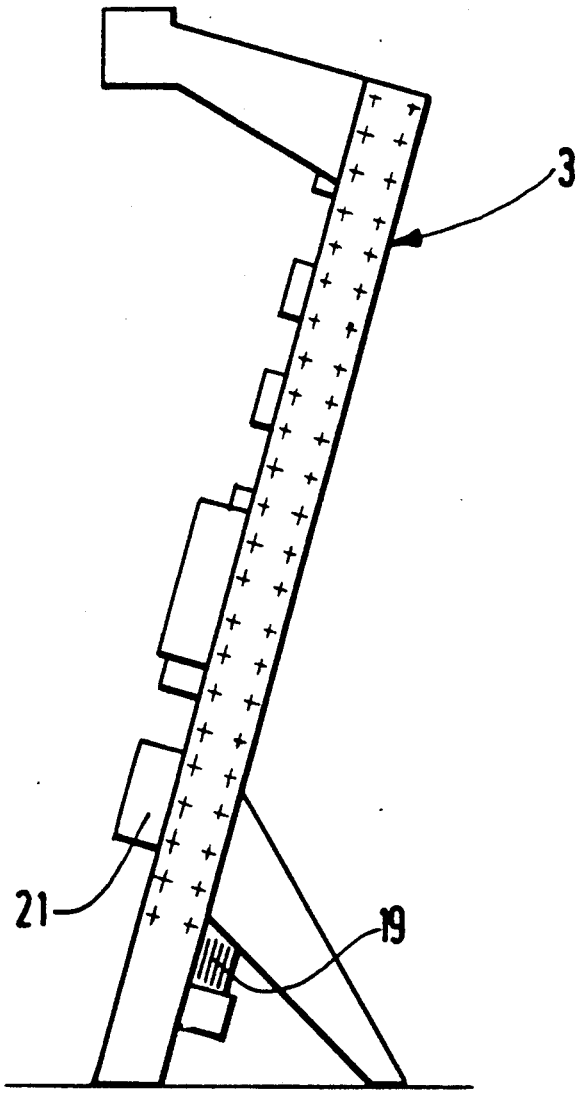
FIG. 2 is a side view of the machine according to FIG. 1.
Figure 3:
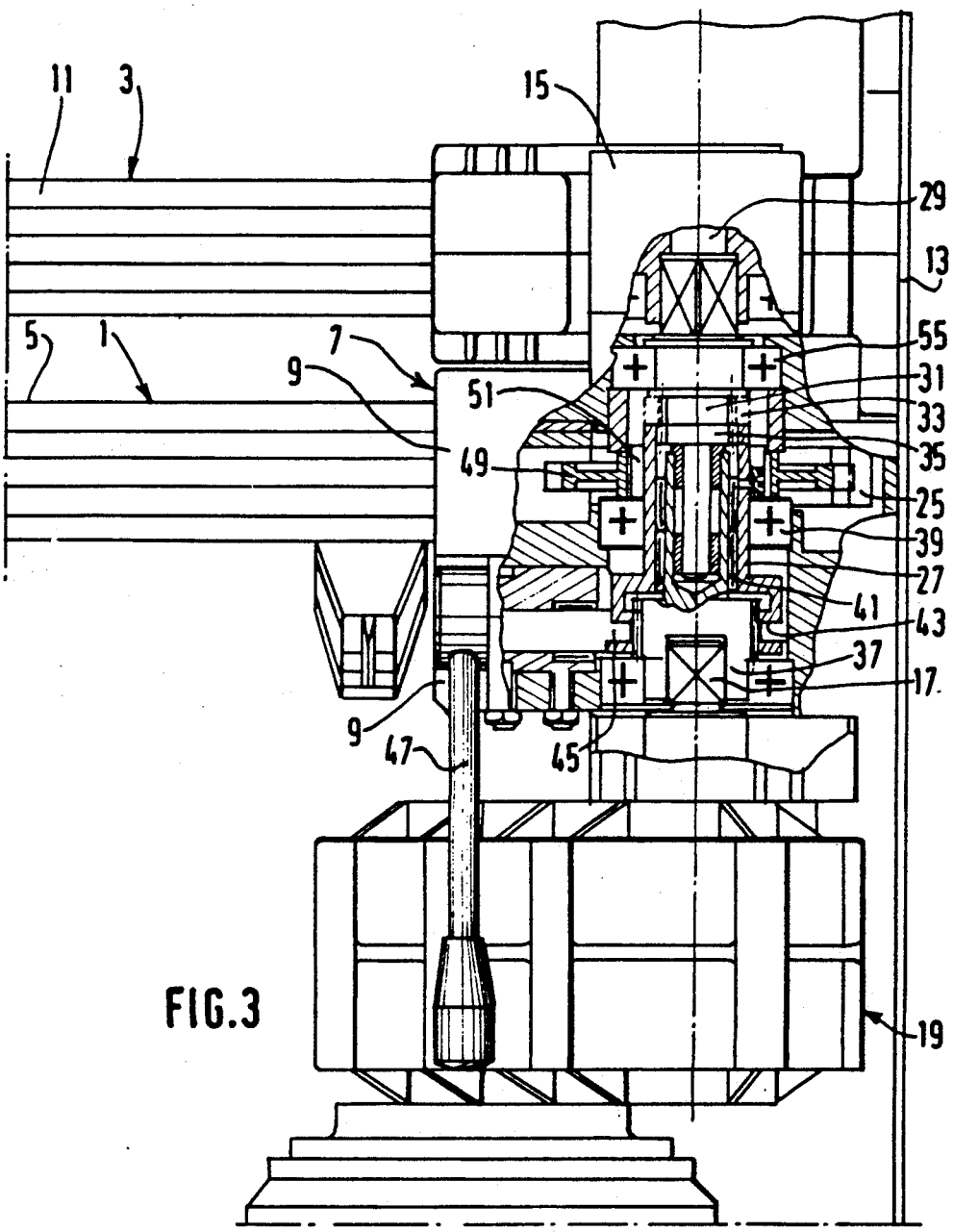
FIG. 3 shows a view, on a larger scale, of a stirring apparatus according to the invention, with the positive-locking component of the declutching system partially cut-away.

As shown in FIG. 1 at the bottom and on the right and in FIG. 2, the stirring apparatus according to the invention, indicated in its entirety by the reference 1, is mounted on paint stirring machines 3 of the hanging-pot type. This apparatus consists of a small rack 5, which is identical as regards its operating principle to that of the racks of the machine, and of an adjoining declutching system 7. The declutching system 7 is enclosed inside a housing 9 (FIG. 3), which is fixed at the top to the bottom rack 11 of the machine along the side upright 13 by means of flanges 15 engaged on either side of this rack, and at the bottom to the output 17 of the geared motor unit 19 of the machine. This fixing method 15 is identical to the conventional method of fixing the geared motor on the machine and also serves as a support for the said motor with respect to the machine. The rack 5, integral with the said housing 9, is arranged underneath the bottom machine rack 11 adjacent and close to the latter. Its length is sufficiently small to carry two pots 21, preferably of different diameters (1 and 5 litres), one of the pots (with the large diameter) having been shown partially cut-away in order to reveal the machine's geared motor unit 19 positioned behind. It ends conventionally at the front with a half-moon element 23 serving to guide the chain 25 on its front rounded end.

The positive-locking component 27 of the declutching system 7 is arranged on the shaft line 29 for transmitting movement to the racks, between the output 17 of the geared motor and the end 31 of the line of shafting to the racks. It carries at its top end a toothed ring 33 and the line end 31 an additional ring 35. Its body is essentially tubular. This component, locked in rotation with the output of the motor by a conventional vertical key 37, slides vertically a small distance, allowing meshing with the toothed ring 35 of the shafting end (non-working position where the continuity of the shafting is ensured) or uncoupling thereof (working position) where the transmission of movement to the machine is interrupted. Guiding of the sliding movement of this component is ensured in its middle part on the outside by a ball bearing 39 and on its internal bore by a roller bearing 41. Its base comprises a peripheral recess 43 cooperating with the eccentric bottom end 45 of a rotating operating lever 47. The pinion 49 driving the adjoining rack 5 is locked in rotation with its body (towards its top part) by a conventional vertical key 51, kept in a position of constant height between the abovementioned bearing 39 and a stop part 53 integral with the housing 9 and also resting on a rotational guiding bearing 55 of the shafting end. In the lowered position of the operating lever 47 (non-working position), coupling with the shafting end 31 is effected, such that selective stirring of the colors on the rack 5 of the apparatus cannot be performed. All the racks are driven by the propulsion of the machine's geared motor. In the raised position of lever 47 (toothed ring shown in dot-dash lines), the toothed ring 33 of the positive-locking component is uncoupled from the ring 35 of the shafting end and frees the latter such that selective stirring of the colors is permitted.

It will be noted that other forms of positive-locking may be used for the apparatus of the invention, but the arrangement described above offers an excellent compromise as regards use of the lower space in the machine and the ease with which the declutching system can be operated so as to assume the working or non-working position.

We claim:

1. A stirring arrangement comprising an accessory for selective stirring of the base colors contained in hanging paint pots in paint stirring machines, said stirring machines having racks for suspending said pots and means for stirring the colors therein, said stirring arrangement including a further rack receiving at least one stirring lid with an associated paint pot, suspended between cantilever slides on the rack; the lid and a stirrer which is attached thereto being rotated by a chain extending along the length of the further rack and actuating a drive pinion thereon, a drive means for driving said chain connected to a drive shaft of the stirring machine so as to disengage the machine in the operating condition of said stirring lid on said further rack (5) without the racks on the stirring machine being activated, and in the inoperative condition of said further rack intermittently activating the racks of the stirring machine, said accessory stirring arrangement being mounted so as to be fixed by a drive housing (9) along a machine upright (13) forming a shaft structure for operating the machine racks (11) extending between a first bottom rack (11) on said machine and a gear motor unit (19), said further rack (5) adjoining said drive housing (9) and being located below said bottom rack (11) adjacent to and at a spacing therefrom.

2. Arrangement according to claim 1, wherein a positive-locking component (27) has the pinion (49) for driving the further rack (5) engaged therewith, said component having a lower end connected with an output shaft (17) of the gear motor unit and an upper end selectively connectable or disconnectable from an end (31) of the machine shaft structure by vertical displacement of said component, said component being movable by an operating lever (47) into a working position for selective stirring by rotating of the lid on said further rack or into inoperative position coupled with the shaft structure.

3. Arrangement according to claim 2, wherein the upper end of the positive-locking component (27) includes a toothed ring (33) cooperating with further ring (35) on the shaft structure.

4. Arrangement according to claim 2, wherein said positive-locking component (27) is slidably actuated by a rotating operating lever (47), a cylindrical base on said lever having an eccentric end (45) cooperating with a peripheral groove (45) formed in the lower end of said component.

5. Arrangement according to claim 2, wherein the pinion (49) driving the further rack (5) for the selective stirring of the colors is rotatably latched to the positive-locking component (27), said pinion being maintained in a position of constant height.

* * * * *